US005132737A

United States Patent [19]

Takeda et al.

[11] Patent Number: 5,132,737

[45] Date of Patent: Jul. 21, 1992

[54] IMAGE FORMING APPARATUS WITH ADSORPTION MEANS

[75] Inventors: Atsushi Takeda, Yokohama; Takashi Hasegawa, Matsudo, both of Japan

[73] Assignee: Canon Kabushiki Kaisha, Tokyo, Japan

[21] Appl. No.: 447,592

[22] Filed: Dec. 8, 1989

[30] Foreign Application Priority Data

Dec. 9, 1988 [JP] Japan ..... 63-310091

[51] Int. Cl.[5] ..... G03G 15/00

[52] U.S. Cl. ..... 355/271; 355/326

[58] Field of Search ..... 355/271, 272, 274, 326, 355/327; 430/126

[56] References Cited

U.S. PATENT DOCUMENTS

| | | | |
|---|---|---|---|
| 3,702,482 | 11/1972 | Doicimascio et al. . | |
| 4,676,627 | 6/1987 | Ohno . | |
| 4,723,145 | 2/1988 | Takada et al. . | |
| 4,864,367 | 9/1989 | Nakahara et al. | 355/272 |
| 4,888,621 | 12/1989 | Ohno | 355/271 |

FOREIGN PATENT DOCUMENTS

| | | | |
|---|---|---|---|
| 54-19752 | 2/1979 | Japan . | |
| 55-32079 | 3/1980 | Japan . | |
| 56-107256 | 8/1981 | Japan | 355/271 |
| 57-64765 | 4/1982 | Japan | 355/271 |
| 58-82271 | 5/1983 | Japan | 355/271 |
| 59-119373 | 7/1984 | Japan . | |
| 61-100770 | 5/1986 | Japan | 355/271 |
| 61-120179 | 6/1986 | Japan . | |
| 61-86971 | 8/1986 | Japan | 355/271 |
| 61-196275 | 8/1986 | Japan . | |
| 61-243474 | 10/1986 | Japan | 355/271 |
| 62-215979 | 9/1987 | Japan . | |

*Primary Examiner*—R. L. Moses

*Attorney, Agent, or Firm*—Fitzpatrick, Cella, Harper & Scinto

[57] ABSTRACT

An image forming apparatus includes an imager for forming an image at an image forming position on an image supporting member, a movable carrier for carrying the image supporting member on a first side thereof and for conveying the image supporting member to the image forming position in order to perform the image formation, an adsorption device for causing the image supporting member to be ewlectrostatically adsorbed or adhered onto the carrier device. The adsorption device is provided at an upstream side of the image forming position in the direction of movement of the carrier. The adsorption device comprises a corona charger provided at a second side of the carrier opposite to the first side. A contact member for contacting the second side of the carrier is provided adjacent to the corona charger.

44 Claims, 5 Drawing Sheets

IMAGE FORMING APPARATUS WITH ADSORPTION MEANS

BACKGROUND OF THE INVENTION

1. Field of the Invention

This invention relates to an image forming apparatus, such as an electrophotographic apparatus, an electrostatic recording apparatus or the like, and more particularly, to an image forming apparatus which is suitable when a transfer material is adsorbed or adhered onto a carrying sheet for electrostatically transferring a toner image on an image carrying member to the transfer material held on the carrying sheet.

2. Description of the Related Art

In a color electrophotographic copier, a transfer drum is configured by winding a carrying member generally in the form of a carrying sheet such as a high-resistance film, around a drum-like frame. A transfer material is supplied to the transfer drum and wound therearound, and an end of the transfer material is mechanically fixed and held by a gripper disposed at a part of the circumferential surface of the transfer drum. Alternatively, the transfer material is fixed and held on the carrying sheet by electrostatically providing an adsorption force between the carrying sheet and the transfer material while winding the transfer sheet (as described in Japanese Patent Public Disclosure (Kokai) No. 55-32079 (1980)). In this way, an image supporting member (the transfer material) is carried by carrying means (the transfer drum) to a transfer position.

In the process of rotating the transfer drum a plurality of times, a toner image having plural colors is electrostatically transferred from an image carrying member (such as a photosensitive drum) to the surface of the transfer material. For this purpose, a corona charging device is disposed behind the carrying sheet at the transfer position, or a conductive roller is disposed in rotational contact with the transfer material held on the carrying sheet, whereby electric charges having a polarity opposite to that of the toner image are supplied to the transfer material. Subsequently, in order to discharge the transfer material from the carrying sheet, the electrostatic adsorption force (Coulomb force) produced between the transfer material and the carrying sheet is weakened using a corona discharger, and a separation claw is inserted between the transfer material and the carrying sheet to separate the transfer material.

In the conventional image forming apparatus as described above, however, a gap is occasionally produced locally between the transfer material and the carrying sheet when holding the transfer material on the carrying sheet. This happens when a transfer material holding surface of the carrying sheet is deformed. Such deformations are commonly caused by a cleaning member which bears against the carrying sheet when cleaning the carrying sheet, electrostatic forces produced by charging of the carrying sheet, thermal deformations from a fixing device situated near the moving region of the carrying sheet, the reaction of the carrying sheet when the transfer material contacts the carrying sheet, and the like. Transfer efficiency decreases where there is a gap, and there may arise a region where transfer is not achieved at all. Furthermore, when there is a large deformed region in the carrying sheet, jamming easily occurs, especially if the carrying sheet is convex relative to the transfer material holding surface. Finally, gaps decrease the effectiveness of the electrostatic adsorption of the transfer material, producing deviation in the position of the transfer material on the carrying sheet. These phonomena are even more pronounced when the transfer material is held on the carrying sheet with an electrostatic adsorption force, i.e. without using a mechanical gripper.

If portions of the transfer material become detached from the carrying sheet after image transfer, contamination of the image transferred occasionally occurs, caused by the contact of the transfer material with members around the transfer drum which disturbs the image on the transfer material.

SUMMARY OF THE INVENTION

The present invention has been made in consideration of the above-described problems.

It is an object of the present invention to provide an image forming apparatus for reliably adsorbing an image supporting member onto carrying means.

It is a further object of the present invention to provide an image forming apparatus which removes distortions and deformations in such carrying means, and in which an image supporting member can be adhered closely to the carrying means without producing a gap.

It is a further object of the present invention to provide an image forming apparatus capable of forming superior images on an image supporting member carried on carrying means by providing superior adhesive property between the image supporting member and the carrying means.

It is a further object of the present invention to provide an image forming apparatus which prevents the occurrence of jamming of an image supporting member by removing distortions in such carrying means.

It is a further object of the present invention to provide an image forming apparatus which prevents contamination in an already-transferred image due to the contact of an image supporting member with other members around the image supporting member by reliably carrying the image supporting member on carrying means.

In one aspect of the invention, there is provided an image forming apparatus including image forming means for forming an image on an image supporting member at an image forming position, carrying means for carrying the image supporting member on a first side thereof and for conveying the image supporting member to the image forming position, adsorption means for causing the image supporting member to be adsorbed onto the carrying means, the adsorption means being provided at an upstream position relative to the image forming position, and a contact member provided adjacent the adsorption means at the second side of the carrying means.

DETAILED DESCRIPTION OF THE PREFERRED EMBODIMENTS

The preferred embodiments of the present invention will be hereinafter explained with reference to the drawings.

Figure 1:
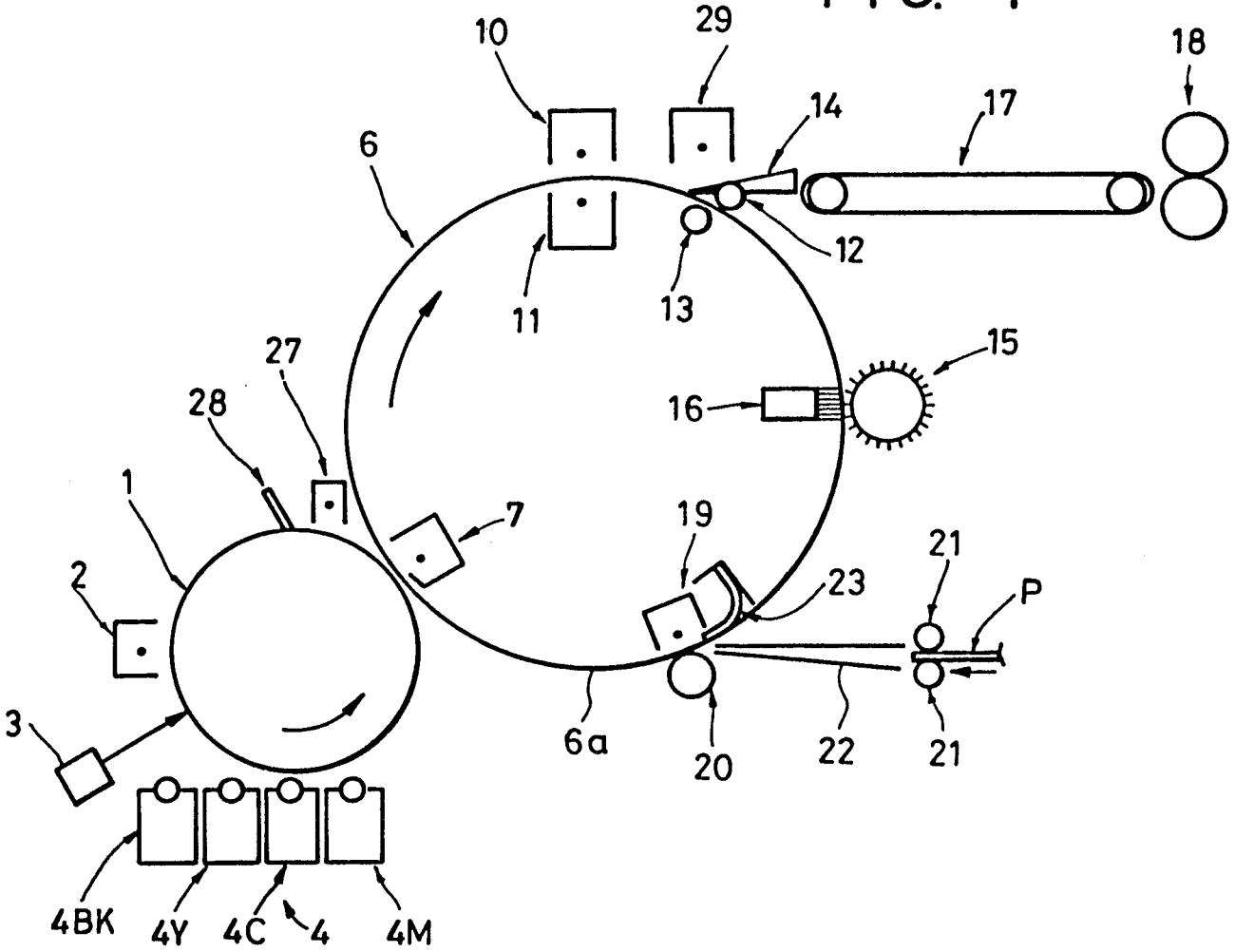
FIG. 1 is a schematic cross-sectional view showing an embodiment of the image forming apparatus of the present invention.

In FIG. 1, a photosensitve drum 1 as an image carrying member is rotatably supported at the center of the drum, and is rotatably driven in the direction of the arrow. Facing the outer circumferential surface of the photosensitive drum 1, a charger 2, an optical system 3 and a developer supplier 4 are disposed in the direction of rotation of the drum 1. The charger 2 provides a uniform charged amount on the photosensitive drum 1. The optical system 3 provides an optical image subjected to color separation with a predetermined timing or a light beam L corresponding thereto on the surface of the photosensitive drum 1 to form an electrostatic latent image. A laser-beam exposure apparatus or the like is used for the optical system 3. The developer supplier 4 is of movable type which faces the surface of the photosensitive drum 1 and moves in the tangential direction, and is provided with four developing devices 4M, 4C, 4Y and 4BK housing four-color developers (toners), that is, magenta, cyan, yellow and black developers, respectively. The developer supplier 4 faces the developing device selected in accordance with the optical image of the color selected by the optical system 3 or the irradiation of the corresponding light beam L relative to the photosensitive drum 1, and electrostatically provides toner to develop a toner image on the surface of the photosensitive drum 1.

A transfer drum 6 for carrying a transfer material, such as paper or the like, as an image supporting member is situated in the direction of rotation of the photosensitive drum 1, in contact with or slightly apart from the surface of the photosensitive drum 1. On the transfer drum 6, a carrying sheet 6a consisting of a dielectric sheet, such as polyvinylidene flouride resin or the like, is cylindrically wound between cylindrical end frames (see FIG. 6). A corona charger 7 for transfer is disposed at the side opposite to the holding surface of the carrying sheet 6a facing the photosensitive drum 1. The transfer drum 6 is rotatably driven in the direction of the arrow. A corona charger 19 for adsorption is disposed at the side opposite to the holding surface of the transfer material by the transfer drum 6 at an upstream position in the direction of movement of the transfer drum 6 relative to the transfer position, that is, the position where the photosensitive drum 1 faces the corona charger 7 for transferring a toner image from the photosensitive drum to the transfer material. A conductive roller 20 is disposed at the side of the holding surface for the transfer material, facing the corona charger 19 for adsorption of the transfer material onto the transfer drum 6. Together, the corona charger 19 and conductive roller 20 comprise charging means. Corona dischargers 10 and 11 for removing charges are disposed facing both surfaces of the carrying sheet 6a at a downstream position in the direction of movement of the transfer drum 6 relative to the transfer position. Pushing rollers 12 and 13, which selectively deform on the carrying sheet 6a for separating the transfer material from the carrying sheet 6a, are also disposed facing both surfaces of the carrying sheet 6a, and a claw 14 for separation is disposed nearby. At a further downstream position, there is provided a brush roller 15 for cleaning the holding surface of the carrying sheet 6a and, if necessary, a brush-type charge remover 16 or corona discharger (not illustrated) for removing adhesion force (residual Coulomb force or van der Waals force).

The transfer material P, which is separated by the claw 14 and on which a toner image is formed, is supplied toward a fixing roller 18 via a conveyor 17, and the image developed by the toner on the transfer material P is fixed.

At an immediately upstream position in the direction of movement of the transfer drum P from the corona charger 19 as charging means and the conductive roller 20, there is provided transfer-material supply means for supplying the transfer material P to the holding surface of the carrying sheet 6a by guiding it into a guide 22 via resist rollers 21, 21.

Figure 5:
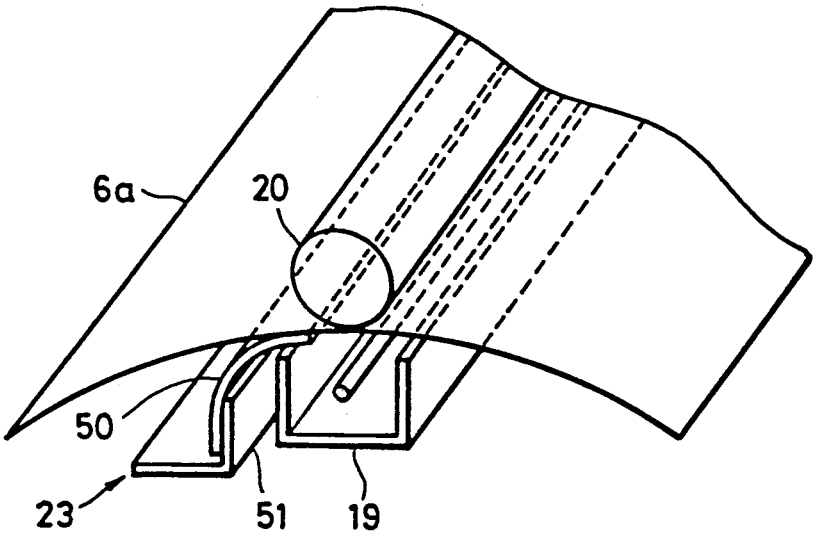
FIG. 5 is a perspective view showing a state in which an elastic sheet contacts the carrying means.

In the present embodiment, at a position where the transfer material P is supplied to the carrying sheet 6a, there is provided distortion correction means 23 made of an elastic supporting member, such as an elastic sheet 150 μm thick, is provided contacting the surface opposite to the holding surface of the carrying sheet 6a and adjacent to the corona charger 19. As shown in FIG. 5, the correction means 23 consists of an elastic sheet 50 extending toward the direction of the center shaft of the transfer drum 6 and a holding member 51 for holding the elastic sheet 50. The elastic sheet 50 is made of a dielectric sheet, such as a polyester film or the like. The elastic sheet 50 presses and holds the carrying sheet 6a from the inner side for correcting mechanical deformation due to the brush roller 15 and the like or deformation due to an electrostatic force by the corona charger 19. In this case, the elastic force of the correction means 23 may be provided in a direction so as to stretch the carrying sheet 6a. This direction is a direction in which the free end of the elastic sheet 50 extends in a downstream direction relative to holding member 51. However, the elastic sheet 50 may be provided at the direction opposite to the above-described direction. Although the elastic sheet 50 is provided at a more upstream side than the adsorption position in the direction of movement of the transfer drum 6 in FIG. 1, it is also possible to provide it on the opposite side of the adsorption position.

Thus, it is possible to reduce distortion in the radial direction of the carrying sheet 6a.

As described above, various cases are possible for the arrangement of the elastic sheet 50. However, the most preferred is a case in which the elastic sheet 50 is provided close to the corona charger 19 at a more upstream side than the adsorption position in the direction of movement of the carrying sheet 6a. In this position, the distortion of the carrying sheet 6a in the radial direction can substantially be prevented. For example, it becomes possible to reduce the shock due to the contact of the transfer material P with the carrying sheet 6a that is produced when the direction of supplying the transfer material P to the carrying sheet 6a differs from the tangential direction at the contact point of the carrying sheet 6a with the roller 20 as shown in FIG. 1. Furthermore, by providing the free-end position of the elastic sheet 50 within the corona discharge region when the elastic sheet 50 is provided in the direction as shown in FIG. 1, it is also possible to regulate the discharge region in the circumferential direction of the corona charger 19. In this case, the boundary between the portion where electric charges for adsorption are supplied to the carrying sheet 6a and the portion where the charges are not provided becomes sharp, and it is possible to perform an adsorption which is better than in a case in which electric charges for adsorption are gradually supplied without regulating the corona discharge region.

In FIG. 1, a charge remover 27 removes static electric charges on the surface of the photosensitive drum 1, and a cleaning blade 28 removes waste toner. If necessary, a corona discharger 29 may be provided near the claw 14 for separation to perform AC corona discharge for the purpose of preventing disturbance in image due to discharge at peeling caused when the transfer material P is separated from the carrying sheet 6a.

In such a configuration, when a color image passing through, for example, a green filter is first irradiated on the surface of the photosensitive drum 1 by the optical system 3 in a state in which the surface of the photosensitive drum 1 is uniformly charaged by the primary charger 2, a latent image consisting mainly of the magenta component among color images is formed thereon. In synchronization with the feeding of the latent image, the developer supplier 4 moves the developing device 4M housing the magenta developer in the tangential direction to the photosensitive drum 1 to face it relative to the photosensitive drum 1, and electrostatically provides the toner to develop a magenta image on the photosensitive drum 1.

On the other hand, the transfer material P is guided into the guide 22 with the function of the resist rollers 21, 21, and is further supplied to the position of the conductive roller 20 along the surface of the carrying sheet 6a. The transfer material P is electrostatically adsorbed and held onto the carrying sheet 6a having curvature at the adsorption position by supplying the carrying sheet 6a with electric charges having a polarity identical to that of the charger 7 for transfer by the corona charger 19. Electrostatic adsorption is produced by the following process. A voltage (for example, positive) having a polarity identical to that of the corona charger 7 for transfter is applied to the corona charger 19. Positive charges are therefore supplied to the dielectric carrying sheet 6a, and current thereby flows through the grounded conductive roller 20 to induce negative charges in the transfer material P. Hence, the positive charges on the carrying sheet 6a and the negative charges on the transfer material P attract each other. Electric charges are thus supplied on the carrying sheet 6a and the transfer material P by the corona charger 19 and the conductive roller 20.

The transfer material P electrostatically adsorbed on the carrying sheet 6a is sent to the transfer position where the photosensitive drum 1 faces the corona discharger 7 for transfer, that is, the image forming position where the toner image is formed on the transfer material P by the movement of the transfer drum 6.

In this case, the feed timing of the resist rollers 21, 21 is in synchronization with the timing for forming the latent image by the optical system 3, and both timings coincide with each other at the transfer position. At the transfer position, an electric field for transfer is generated by the corona charger 7 for transfer which supplies electric charges having a polarity opposite to that of the toner, and the toner on the photosensitive drum 1 is held on the transfer material P by electric charges supplied to the carrying sheet 6a.

The electric charges in the residual toner on the photosensitive drum 1 are removed by the charge remover 27. The residual toner is then removed by the blade 28, and the surface of the photosensitive drum 1 is cleaned. On the other hand, the transfer material P adsorbed on the carrying sheet 6a is moved in accordance with the rotation of the transfer drum 6 while carrying the toner image, and passes through between the corona dischargers 10 and 11. At this moment, the corona dischargers 10 and 11 are not energized, and the pushing rollers 12 and 13 are separated from the carrying sheet 6a. The brush roller 15, the corona discharger or brush-type charge remover 16 and the conductive roller 20 are also separated from the carrying sheet 6a. Accordingly, the transfer material P passes through between the coroner charger 19 and the conductive roller 20 without disturbing the toner image on the transfer material P held by Coulomb force, and is sent again to the transfer position.

As to the energization of the corona charger 19 and the contact of the conductive roller 20 with the transfer material P, before the front end of the toner image on the transfer material P reaches the above-described position of the corona charger 19 and the conductive roller 20, the voltage applied to the corona charger 19 has been turned off, and, as mentioned above, the conductive roller 20 has been separated from the carrying sheet 6a. Hence, when the transfer material P passes through between the corona charger 19 and the conductive roller 20, electric charges for adsorption are not supplied to the transfer material P. Furthermore, before the front end of the toner image reaches the transfer position, image formation by the magenta developer has been completed, and the optical system 3 has already irradiated a color image passing through a red filter on the photosensitive drum 1. The developer supplier 4 shifts the developing device 4C against the photosensitive drum 1, and electrostatically provides the toner toward the latent imaage to develop a cyan image on the photosensitive drum 1. For this purpose, a toner image by the cyan developer is transferred overlapped with the preceding toner image by the magenta developer at the transfer position.

Thus, the optical system 3 irradiates optical images, which are obtained by performing color separation relative to an identical image a plurality of times while sequentially providing green, red and blue filters, on the photosensitive drum 1 to form latent images. The developer supplier 4 supplies the photosensitive drum 1 with corresponding developers, that is, magenta, cyan and yellow developers to perform color development as a whole. The sequence of providing the filters and supplying the developers can of course be appropriately selected according to requirements.

After the final toner image, which is an image by the yellow developer in the present embodiment, has been transferred onto the transfer material P, the corona dischargers 10 and 11 are energized when the transfer material P passes through between them to remove the electric charges, and the pushing rollers 12 and 13 are pressed against the carrying sheet 6a to increase curvature at the pressed portion and to aid peeling of the transfer material P from the carrying sheet 6a. The claw 14 for separation contacts or comes close to the carrying sheet 6a to separate the front end of the transfer material P from the carrying sheet 6a and to supply the transfer material P to the fixing rollers 18 via the conveyor 17. The fixing rollers 18 then fix the toner image on the transfer material P. In separating the transfer material P, disturbance of the image due to discharge at peeling may be prevented by the corona discharger 29. The surface of the carrying sheet 6a after the separation of the transfer material P is cleaned by the brush 15. At this time, if the residual toner still continues to keep the electrostatic adhesion force, cleaning cannot be performed satisfactorily. The removal of the residual toner by the corona discharger or brush-type charge remover 16 provides an effective cleaning.

The reproduction of a color image can thus be performed. When the filters are not used in the optical system 3 and the developing device 4BK for the black developer is faced against the photosensitive drum 1 in the developer supplier 4, a normal black-and-white reproduction can be performed. In this case, since only one transfer is performed, there is provided the function of each component which corresponds to the case of the final development in color reproduction.

If necessary, in the final stage of color development, the exposure of white light and a black image by the black developer may be superposed.

Particularly in the present embodiment, before the transfer material P is electrostatically adsorbed and held on the carrying sheet 6a, uneven deformation of the carrying sheet 6a is corrected by the distortion correction means 23 to prevent an adsorption state causing a local gap. Hence, there is no danger of causing jamming or producing a region where transfer is not performed. Although the correction means 23 uses an elastic sheet 50 in the present embodiment, it may of course be replaced by other configurations.

Figure 2:
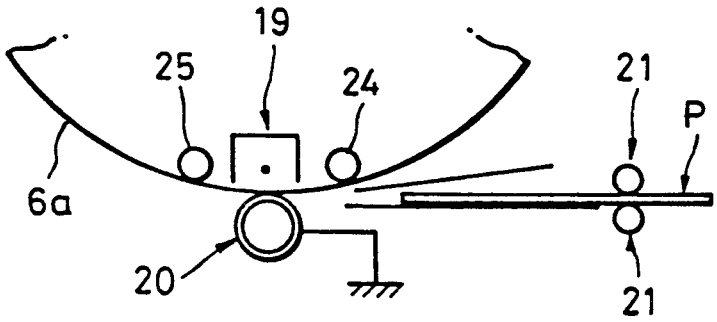
FIG. 2 is a side view showing an embodiment of correction means for correcting distortion in the carrying means.
Figure 3:
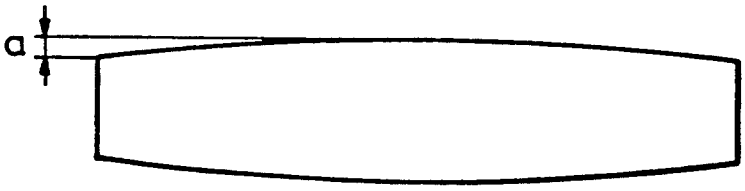
FIG. 3 is a front view showing a crowned shape of a roller.

In an embodiment shown in FIG. 2, the correction means 23 comprises rollers 24 and 25 which are disposed facing and adjacent to the corona charger 19 at upstream and downstream sides relative to the corona charger 19 in the direction of movement of the transfer drum 6, respectively. The conductive roller 20 also has the function of the correction means 23. The rollers 24 and 25 aid in correcting uneven deformation of the carrying sheet 6a before the transfer material P is received and adsorbed onto the carrying sheet 6a. The conductive roller 20 has a crowned shape with a difference "a" in diameter as shown in FIG. 3, and adsorbs the transfer material P guided between the carrying sheet 6a and the conductive roller 20 first from its center. Hence, distortion is pushed out toward the circumference, and electrostatic adsorption between the carrying sheet 6a and the transfer material P is reliably performed. According to experiments, failure in adsorption can be nearly prevented even when the difference "a" in diameter is within 50 μm -1mm.

Although the conductive roller 20 is grounded in the present embodiment, it may be connected to voltage application means such as a biasing power supply to constitute electric-charge supply means together with the corona charger 19.

Figure 4:
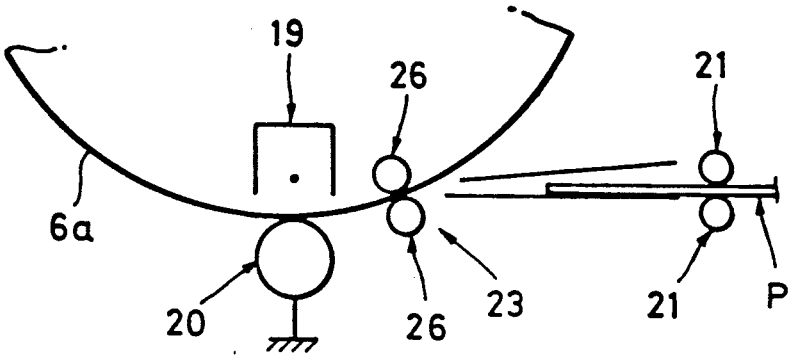
FIG. 4 is a side view showing another embodiment of the correction means.

In an embodiment shown in FIG. 4, the correction means 23 comprises a pair of rollers 26 provided at both sides of the carrying sheet 6a adjacent to and facing each other and located immediately upstream of the electrostatic adsorption means consisting of the corona charger 19 and the conductive roller 20. Rollers 26 are retracted from carrying sheet 6A when transfer material P, bearing an unfixed toner image, is recirculated past the rollers. The pair of rollers 26 has the function of correcting mechanical distortion or distortion caused by the electrostatic force of the carrying sheet 6a, as well as closely contacting the transfer material P coming from transfer-material supply means with the corrected carrying sheet 6a and guiding the transfer material P between the corona charger 19 and the conductive roller 20. At least one of the pair of rollers 26 may of course be formed in the shape of a crown as described above with reference to FIG. 3.

By the function of such correction means 23, the gap between the transfer material P and the carrying sheet 6a can actually be maintained to be 50 μm or less. Hence, failure in adsorption virtually never occurs, and it is also possible to prevent jamming.

Although an explanation has been provided of a configuration in which the transfer material P is adsorbed on the carrying sheet 6a in all the embodiments described above, the correction means of the present invention may of course be applied to a method in which the transfer material P is mechanically fixed and held on the carrying sheet 6a by a mechanical gripper. Furthermore, in order to adsorb the transfer material P onto the transfer drum 6, an opening (or a plurality of pin-hole openings) may be provided in a portion where the transfer material P is carried on the transfer drum 6, and the transfer material P may be adsorbed by sucking air through the opening(s) from within the transfer drum 6.

Figure 6:
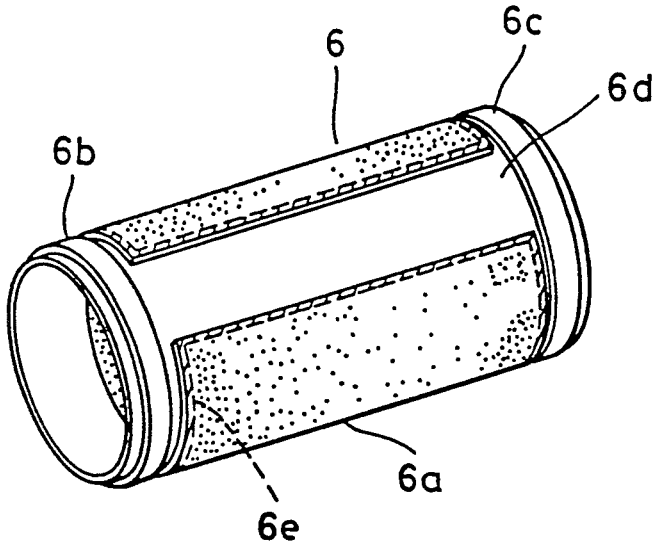
FIG. 6 is a perspective view showing an embodiment of the carrying means of the present invention.

As the transfer drum 6, a drum comprising an endless sheet on which the transfer material P can be adsorbed at an arbitrary position may be used. However, as shown in FIG. 6, it is preferred to use a drum for transfer which includes cylindrical rings 6b and 6c at both ends thereof in its longer direction and a connecting member 6d for connecting the rings, and on which the dielectric carrying sheet 6a is wound and carried in a portion 6e cut away on the surface of the frame of the drum, because the strength of the transfer drum 6 increases and the carrying sheet 6a is hardly deformed. In the case of using the transfer drum 6 as shown in FIG. 6, the use of the corona charger 19 for adsorption as described above is preferred to the use of a conductive roller, to which a biasing voltage is applied, in place of the corona charger 19 for adsorption. The reason is as follows. If a conductive roller is used for the transfer drum 6 as shown in FIG. 6, the transfer drum 6 produces a deviation in rotation when the conductive roller runs over the connecting member 6d by the rotation of the transfer drum 6, and a deviation in image is thereby produced. Accordingly, when the conductive roller is used within the transfer drum, it is necessary to provide a mechanism for separating the conductive roller from the connecting member 6d when it passes over the connecting member 6d. If the corona charger 19 for adsorption is used, however, such a separation mechanism becomes entirely unnecessary, and hence the figuration becomes simpler.

Similarly, as the correction means for contacting the inner side of the transfer drum, the use of an elastic sheet, as shown in FIG. 1, is preferred to the use of rollers, as shown in FIGS. 2 and 4, because the possibilities of transfer sheet deviations are reduced.

Figure 7:
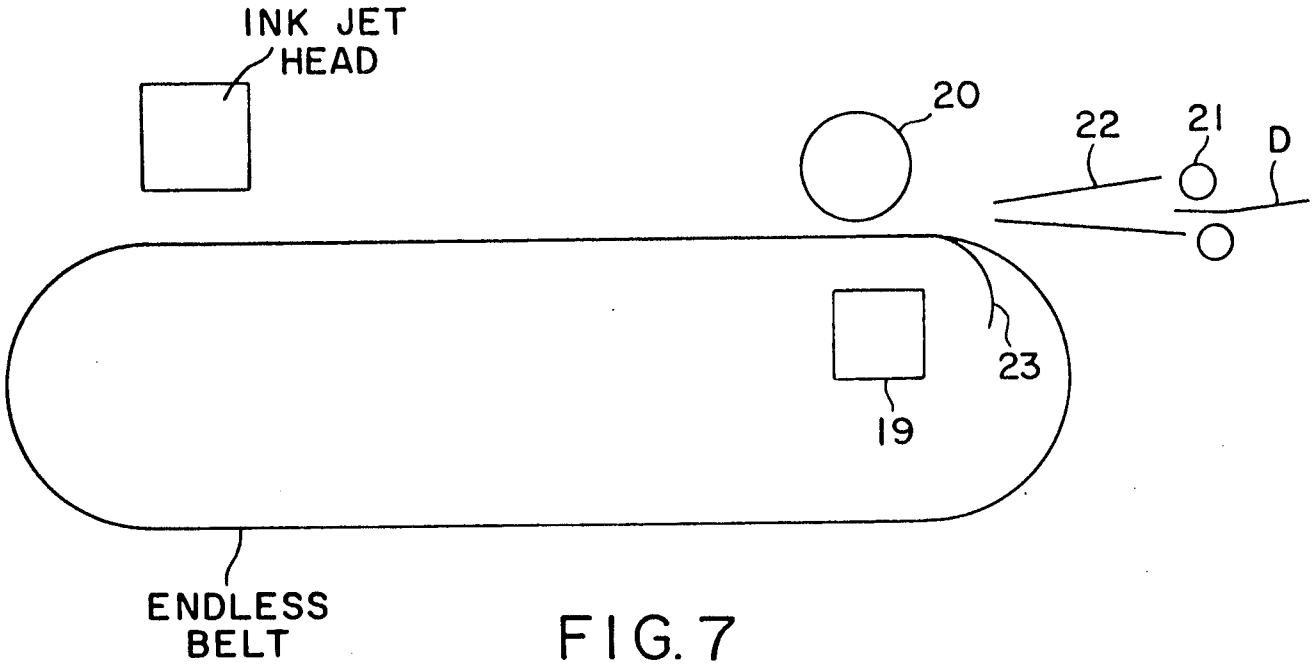
FIG. 7 is a schematic cross section showing an embodiment of the present invention as applied to an ink jet printer.

Although the above-described embodiments use a method in which the toner image formed on the photosensitive drum is transferred on the transfer material as the image supporting member, the present invention may also be applied to a method which does not require transfer, such as the ink-jet method depicted in FIG. 7, in which a recording ink jet head faces an endless belt as carrying means and recording is performed by the ink jet head on an image supporting member, such as paper or the like, electrostatically adsorbed on the belt. Reference numerals in FIG. 7 which are the same as the reference numerals in FIGS. 1, 2 and 4 also correspond to the same components as in FIGS. 1, 2 and 4.

As described above in detail, the image forming apparatus according to the present invention includes members for correcting distortion in carrying means and closely contacting an image supporting member with the carrying means. Hence, it is possible reliably to adsorb the image supporting member, to prevent jamming of the image supporting member, to achieve a high quality image without blank areas, and improve reproducibility of color in the case of color reproduction.

Furthermore, according to the present invention, by securely holding the entire surface of an image supporting member on carrying means and preventing the detachment of the image supporting member from the carrying means, it is possible to prevent contamination of an already-transferred image which might occur by contact with provided around the carrying means.

What is claimed is:

1. An image forming apparatus comprising:

image forming means for forming an image on an image supporting member at an image position of said apparatus;

a movable sheet carrying member for carrying said image supporting member on a first side thereof and for conveying said image supporting member to said image forming position;

adsorption means for causing said image supporting member to be electrostatically adsorbed onto said movable sheet carrying member, said adsorption means being provided upstream of said image forming position, said adsorption means comprising corona charging means provided at a second side of said movable sheet carrying member; and a correcting member for contacting the second side of said movable sheet carrying member and being provided adjacent to said corona charging means.

2. An image forming apparatus according to claim 1, wherein said image forming means comprises a movable image carrying member, means for forming a toner image on said image carrying member, and transfer means for transferring the toner image to said image supporting member carried by said movable sheet carrying member at said image forming position.

3. An image forming apparatus accoring ot claim 2, wherein said corona charging means has a charging polarity identical to that of said transfer means.

4. An image forming apparatus according to claim 2, wherein said transfer means transfers a plurality of toner images to the same image supporting member.

5. An image forming apparatus according to claim 4, wherein said plurality of toner images comprise color toner images.

6. An image forming apparatus according to claim 1, further comprising a contact member provided in contact with the first side of said movable sheet carrying member and facing the corona charging means.

7. An image forming apparatus according to claim 1, wherein said correcting member is provided upstream of said adsorption means in the direction of movement of said movable sheet carrying member.

8. An image forming apparatus according to claim 1, wherein said correcting member comprises a sheet member.

9. An image forming apparatus according to claim 1, wherein said correcting member comprises a roller.

10. An image forming apparatus comprising:

image forming means for forming an image on an image supporting member at an image forming position of said apparatus;

a movable sheet carrying member for carrying said image supporting member on a first side thereof and for conveying said image supporting member to said image forming position adsorption means for causing said image supporting member to be electrostatically adsorbed onto said movable sheet carrying member, said adsorption means being provided upstream of said image forming position, said adsorption means comprising corona charging means provided at a second side of said movable sheet carrying member; and a correcting member for contacting the second side of said movable sheet carrying member and being provided adjacent to said corona charging means, wherein said adsorption means further comprises charging means on said first side and facing said corona charging means.

11. An image forming apparatus according to claim 10, wherein said charging means comprises a contact member for contacting the first side of said movable sheet carrying member.

12. An image forming apparatus according to claim 11, wherein said contact member is a conductive contact member and is grounded.

13. An image forming apparatus according to claim 11, wherein said contact member comprises a roller.

14. An image forming apparatus according to claim 10, wherein said image forming means comprises a movable image carrying member, means for forming a toner image on said image carrying member, and transfer means for transferring the toner image to said image supporting member carried by said movable sheet carrying member at said image forming position.

15. An image forming apparatus according to claim 14, wherein said corona charging means has a charging polarity identical to that of said transfer means.

16. An image forming apparatus according to claim 14, wherein said transfer means transfers a plurality of toner images to the same image supporting member.

17. An image forming apparatus according to claim 10, wherein said correcting member is provided upstream of said adsorption means in the direction of movement of said movable sheet carrying member.

18. An image forming apparatus comprising:

image forming means for forming an image at an image forming position on an image supporting member;

movable carrying means for carrying said image supporting member on a first side thereof and for conveying said image supporting member to said image forming position adsorption means for causing said image supporting member to be adsorbed onto said carrying means, said adsorption means being provided upstream of said image forming position; and a sheet member adjacent said adsorption means and provided at a second side of said carrying means opposite to said first side so as to contact said image-supporting-member carrying means.

19. An image forming apparatus according to claim 18, wherein said image forming means comprises a movable image carrying member, means for forming a toner image on said image carrying member, and transfer means for transferring the toner image to said image supporting member carried by said carrying means at said image forming position.

20. An image forming apparatus according t claim 19, wherein said adsorption means comprises charging means provided at said second side, and wherein said charging means has a charging polarity identical to that of said transfer means.

21. An image forming apparatus according to claim 19, wherein said transfer means transfers a plurality of toner images to the same image supporting member.

22. An image forming apparatus according to claim 21, wherein said plurality of toner images comprise color toner images.

23. An image forming apparatus according to claim 18, wherein said adsorption means electrostatically adsorbs said image supporting member onto said carrying means.

24. An image forming apparatus according to claim 23, wherein said adsorption means comprises first charging means provided at said first side and second charging means provided at said second side and facing the first charging means.

25. An image forming apparatus according to claim 24, wherein said second charging means comprises corona charging means.

26. An image forming apparatus according to claim 24, wherein said first charging means comprises a contact member for contacting said carrying means at said first side.

27. An image forming apparatus according to claim 26. wherein said contact member comprises a roller.

28. An image forming apparatus according to claim 26, wherein said contact member is a conductive contact member and is grounded.

29. An image forming apparatus according to claim 24, or 21, wherein said sheet member regulates a charging region of said second charging means in the direction of movement of said carrying means.

30. An image forming apparatus according to claim 18, further comprising a contact member provided in contact with said first side of said carrying means and facing said adsorption means.

31. An image forming apparatus according to claim 18, wherein said sheet member is provided upstream of said adsorption means.

32. An image forming apparatus according to claim 18, wherein said sheet member extends in the forward direction relative to the direction of movement of said carrying means.

33. An image forming apparatus according claim 18. wherein said movable carrying means is a dielectric movable endless sheet member.

34. An inmage forming apparatus according to claim 31, wherein a contacting portion of said sheet member with said carrying means is downstream of a supporting portion where said sheet member is supported.

35. An image forming apparatus comprising:

image forming means for forming an image on an image supporting member at an image forming position of said apparatus;

a movable sheet carrying member for carrying said image supporting member on a first side thereof and for conveying said image supporting member to said image forming position;

adsorption means for causing said image supporting member to be electrostatically adsorbed onto said movable sheet carrying member, said adsorption means being provided upstream of said image forming position, said adsorption means comprising corona charging means opposed to said sheet carrying member; and regulating means for regulating a charging region of said corona charging means in the direction of movement of said movable sheet carrying member.

36. An image forming apparatus according to claim 35, wherein said regulating means is provided so that it contacts a second side of said movable sheet carrying member.

37. An image forming apparatus according to claim 35, wherein said regulating means is made of a dielectric material.

38. An image forming apparatus according to one of claims 36 and 37, wherein said regulating means comprises a sheet member.

39. An image forming apparatus according to claim 36, wherein said image forming means comprises a movable image carrying member, means for forming a toner image on said image carrying member, and transfer means for transferring the toner image to said image supporting member carried by said movable sheet carrying member at said image forming position.

40. An image forming apparatus according to claim 39, wherein said corona charging means is provided at a second side of said movable sheet conveying member and has a charging polarity identical to that of said transfer means 41. An image forming apparatus according to claim 39, wherein said transfer means transfers a plurality of toner images to the same image supporting member.

42. An image forming apparatus according to claim 35, wherein said regulating means is provided upstream of said adsorption means in the direction of movement of said movable sheet carrying member.

43. An image forming apparatus according to one of claims 4, 21, 41, and 16, wherein said image forming means forms full-color toner image on said image supporting member.

44. An image forming apparatus according to one of claims 1, 10, and 35, wherein said movable sheet carrying member is a dielectric movable endless member.

* * * * *

UNITED STATES PATENT AND TRADEMARK OFFICE

CERTIFICATE OF CORRECTION

PATENT NO. : 5,132,737

DATED : July 21, 1992

INVENTOR(S) : TAKEDA et al.

It is certified that error appears in the above-identified patent and that said Letters Patent is hereby corrected as shown below:

[57] ABSTRACT:

PAGE 29

Line 10, "ewlectrostatically" should read --electrostatically--.

COLUMN 2

Line 3, "phonomena" should read --phenomena--.

COLUMN 3

Line 14, "photosensitve" should read --photosensitive--.
Line 46, "flouride" should read --fluoride--.

COLUMN 5

Line 24, "charaged" should read --charged--.
Line 46, "transfter" should read --transfer--.

UNITED STATES PATENT AND TRADEMARK OFFICE

CERTIFICATE OF CORRECTION

PATENT NO. : 5,132,737

DATED : July 21, 1992

INVENTOR(S) : TAKEDA et al.

It is certified that error appears in the above-identified patent and that said Letters Patent is hereby corrected as shown below:

COLUMN 9

Line 28, "position" should read --forming position--.
Line 52, "ot" should read -- to--.

COLUMN 11

Line 8, "t" should read --to--.

COLUMN 12

Line 1, "inmage" should read --image--.

Signed and Sealed this

Twenty-eighth Day of September, 1993

Bruce Lehman

BRUCE LEHMAN

*Commissioner of Patents and Trademarks*

*Attest:*

*Attesting Officer*